US008388246B2

(12) United States Patent
Spence et al.

(10) Patent No.: US 8,388,246 B2
(45) Date of Patent: Mar. 5, 2013

(54) WEB DRIVEN VACUUM TRANSPORT

(75) Inventors: James J Spence, Honeoye Falls, NY (US); Douglas F. Sundquist, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 601 days.

(21) Appl. No.: 12/559,832

(22) Filed: Sep. 15, 2009

(65) Prior Publication Data

US 2011/0064506 A1 Mar. 17, 2011

(51) Int. Cl.
*B65H 20/10* (2006.01)

(52) U.S. Cl. ..... 400/611; 347/104; 226/93; 226/95

(58) Field of Classification Search ..... 400/611
See application file for complete search history.

(56) References Cited

U.S. PATENT DOCUMENTS

| | | | | |
|---|---|---|---|---|
| 3,321,121 | A * | 5/1967 | Nyberg et al. | 226/95 |
| 5,442,420 | A * | 8/1995 | Tsuji | 226/95 |
| 5,526,028 | A | 6/1996 | Rottman | |
| 5,717,446 | A * | 2/1998 | Teumer et al. | 347/104 |
| 6,224,715 | B1 | 5/2001 | Siquet | |
| 6,254,092 | B1 * | 7/2001 | Yraceburu et al. | 347/104 |
| 6,387,220 | B1 | 5/2002 | Mohrsen et al. | |
| 6,394,596 | B1 * | 5/2002 | Wotton et al. | 347/104 |
| 6,405,914 | B1 | 6/2002 | Broom et al. | |
| 6,406,017 | B1 * | 6/2002 | Yaneda | 271/276 |
| 6,467,410 | B1 * | 10/2002 | Rasmussen et al. | 347/104 |
| 6,612,236 | B2 * | 9/2003 | Frankenberger et al. | 101/232 |
| 6,672,705 | B2 * | 1/2004 | Kitahara et al. | 347/42 |
| 6,672,720 | B2 * | 1/2004 | Smith | 347/104 |
| 6,978,994 | B2 | 12/2005 | Ingelsten | |
| 6,981,766 | B2 * | 1/2006 | Tsuji | 347/104 |
| 7,422,132 | B2 | 9/2008 | Laitio | |
| 7,510,069 | B2 | 3/2009 | Koljonen et al. | |
| 2001/0050154 | A1 | 12/2001 | Broom et al. | |
| 2002/0067403 | A1 * | 6/2002 | Smith | 347/104 |
| 2007/0119895 | A1 | 5/2007 | Pesch et al. | |
| 2008/0218576 | A1 * | 9/2008 | Phillips et al. | 347/104 |

* cited by examiner

*Primary Examiner* — Jill Culler
(74) *Attorney, Agent, or Firm* — Maginot, Moore & Beck, LLP

(57) ABSTRACT

A web handling module has been developed for horizontally transporting a web under a printer having at least one print head. The web handling module includes a plenum, an air vent coupled to the plenum, the air vent being coupled to an air handler and configured to generate a negative air pressure inside the plenum, a support plate sealingly coupled to the plenum, the support plate having a plurality of apertures configured to allow air to pass through the plurality of apertures, and a porous belt wound about the support plate to form a continuous loop, the porous belt enabling the negative air pressure to couple the porous belt to a web moving over the support plate to rotate the porous belt about the support plate without relative motion occurring between the web and the porous belt.

13 Claims, 9 Drawing Sheets

WEB DRIVEN VACUUM TRANSPORT

TECHNICAL FIELD

The devices and methods disclosed below generally relate to web transport systems, and, more particularly, to a modular web transport system used in the field of web printing.

BACKGROUND

Web transport systems are used in a variety of applications to transport a web from one location to another. In printing applications, a printing assembly including one or multiple print heads positioned near the web prints patterns onto the web. As the ink is ejected on to the web, the web must remain flat and a predictable distance away from the printing assembly. Web unevenness or variations in distance from the printing assembly can result in poor printing quality.

To ensure web flatness, one solution often implemented in the prior art is to stretch the web between two rollers. The distance between the rollers affects the flatness of the web. For example, if the two rollers are placed a long distance from each other the web can unpredictably flutter up and down. To prevent this fluttering action more rollers can be added to the web path to reduce the distance between adjacent rollers and the rollers are positioned to provide an arcuate path for the web. Both the addition of the rollers and the arcuate positioning of the rollers are required to reduce the fluttering action.

FIG. 9 shows a prior art implementation of a web transport system with a series of printing print heads. In order to implement an extended web printing station 10, rollers 20 are provided for print heads 30. The required flatness of the web 40 is maintained by placing a roller 20 under each print head 30 and positioning the rollers to provide an arc. By placing the rollers in an arcuate path, as shown in FIG. 9, the web 40 is ensured to maintain contact with each roller 20. For example, three degrees of contact between each roller and the web may be achieved by the arcuate path shown in FIG. 9.

One challenge with the web transport system of FIG. 9 is that the arcuate path requires print heads to be positioned at different angles. The angular placement of the print heads is necessary to enable the print heads to be perpendicular to the surface of the web. If the print heads are angularly oriented with respect to the web surface poor quality printing may result.

In the web transport system of FIG. 9, a one-to-one correspondence exists between the rollers and the number of print heads. As the number of print heads increases in longer printing systems, so does the number of rollers. Because each roller makes sliding contact with the web, the rollers can dislodge dust and other particulate matter from the web. This particulate matter may affect print quality, require more frequent system cleaning, or necessitate ventilation and removal of the dust from the system.

SUMMARY

A web handling module has been developed for horizontally transporting a web under a printer having at least one print head. The web handling module includes a plenum, an air vent coupled to the plenum, the air vent being coupled to an air handler and configured to generate a negative air pressure inside the plenum, a support plate sealingly coupled to the plenum, the support plate having a plurality of apertures configured to allow air to pass through the plurality of apertures, and a porous belt wound about the support plate to form a continuous loop, the porous belt enabling the negative air pressure to couple the porous belt to a web moving over the support plate to rotate the porous belt about the support plate without relative motion occurring between the web and the porous belt.

A method has also been developed for horizontally moving a web in a printing device with at least one print head above the web. The method includes applying a vacuum through a plurality of apertures in a support plate and through a porous belt positioned over the support plate to couple the porous belt to a web of material, driving the web to rotate the porous belt about the support plate, and ejecting ink from at least one print head onto the web as the web is moving over the support plate.

A printing production environment has also been developed for printing onto a moving web. The printing production environment includes a plurality of web handling modules, each web handling module of the plurality having a plenum, an air vent coupled to the plenum, the air vent being coupled to an air handler and configured to generate a negative air pressure inside the plenum, a support plate sealingly coupled to the plenum, the support plate having a plurality of apertures configured to allow air to pass through the plurality of apertures, a porous belt wound about the support plate to form a continuous loop, the porous belt enabling the negative air pressure to couple the porous belt to a web moving over the support plate to rotate the porous belt about the support plate without relative motion occurring between the web and the porous belt, a web feeder configured to receive the web from a web source and to provide the web to the plurality of the web handling modules, a web stacker configured to receive the web from the plurality of the web handling modules and provide the web to a downstream web handling unit, and a plurality of print heads assigned to each of the plurality of web handling modules disposed above the web and configured to eject ink onto the web as the web is moving over the support plate.

BRIEF DESCRIPTION OF THE DRAWINGS

The foregoing aspects and other features of the present disclosure are explained in the following description, taken in connection with the accompanying drawings.

DETAILED DESCRIPTION

The term "printer" as used herein refers, for example, to reproduction devices in general, such as printers, facsimile machines, copiers, and related multi-function products. While the specification focuses on a web transport system that controls the transport of a web under a series of print heads, the transport system may be used with any web transport system that transports a web from one location to another.

Figure 1:
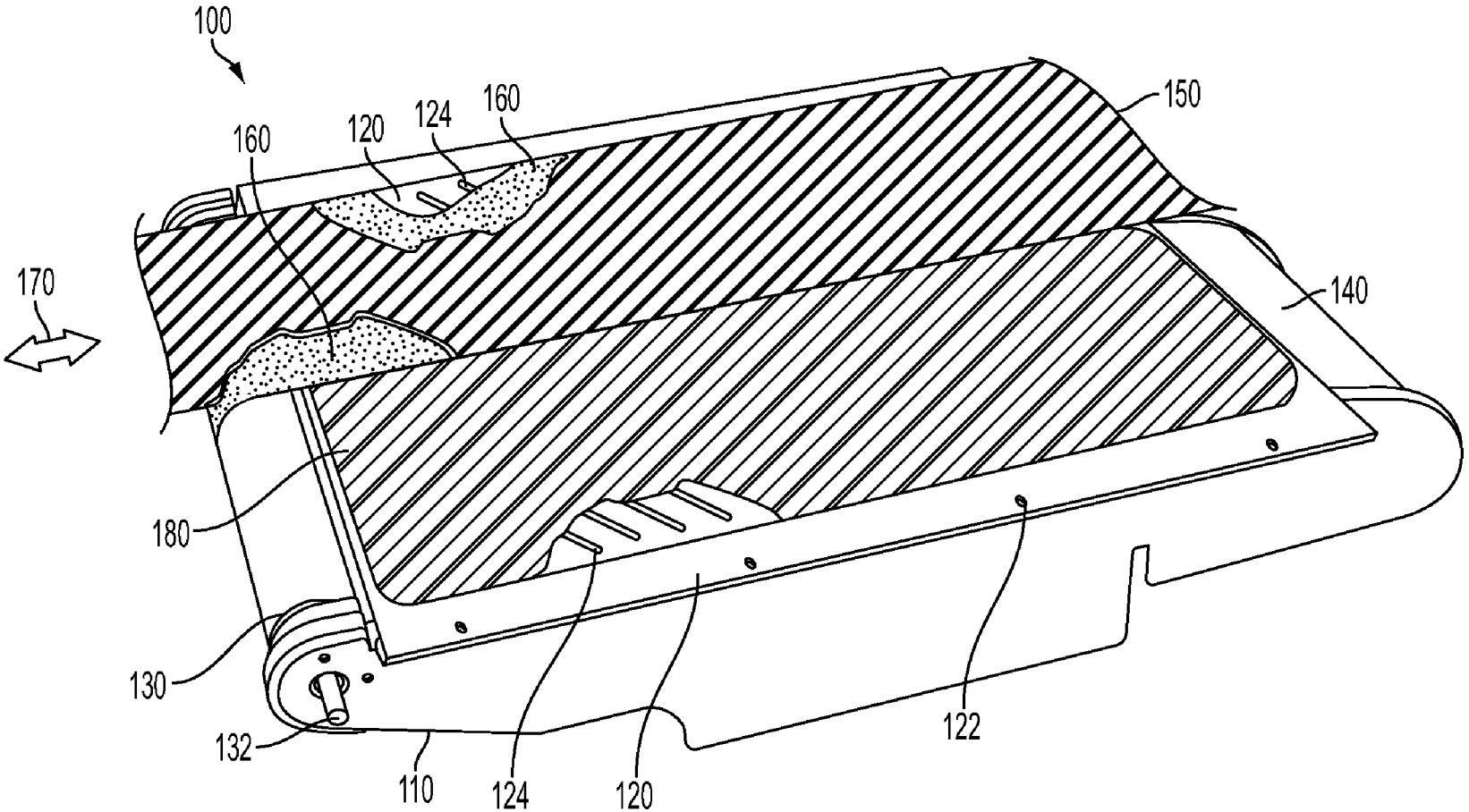
FIG. 1 is a perspective view of a web handling module with the web positioned above the web handling module and cutouts provided to reveal different features.
Figure 2:
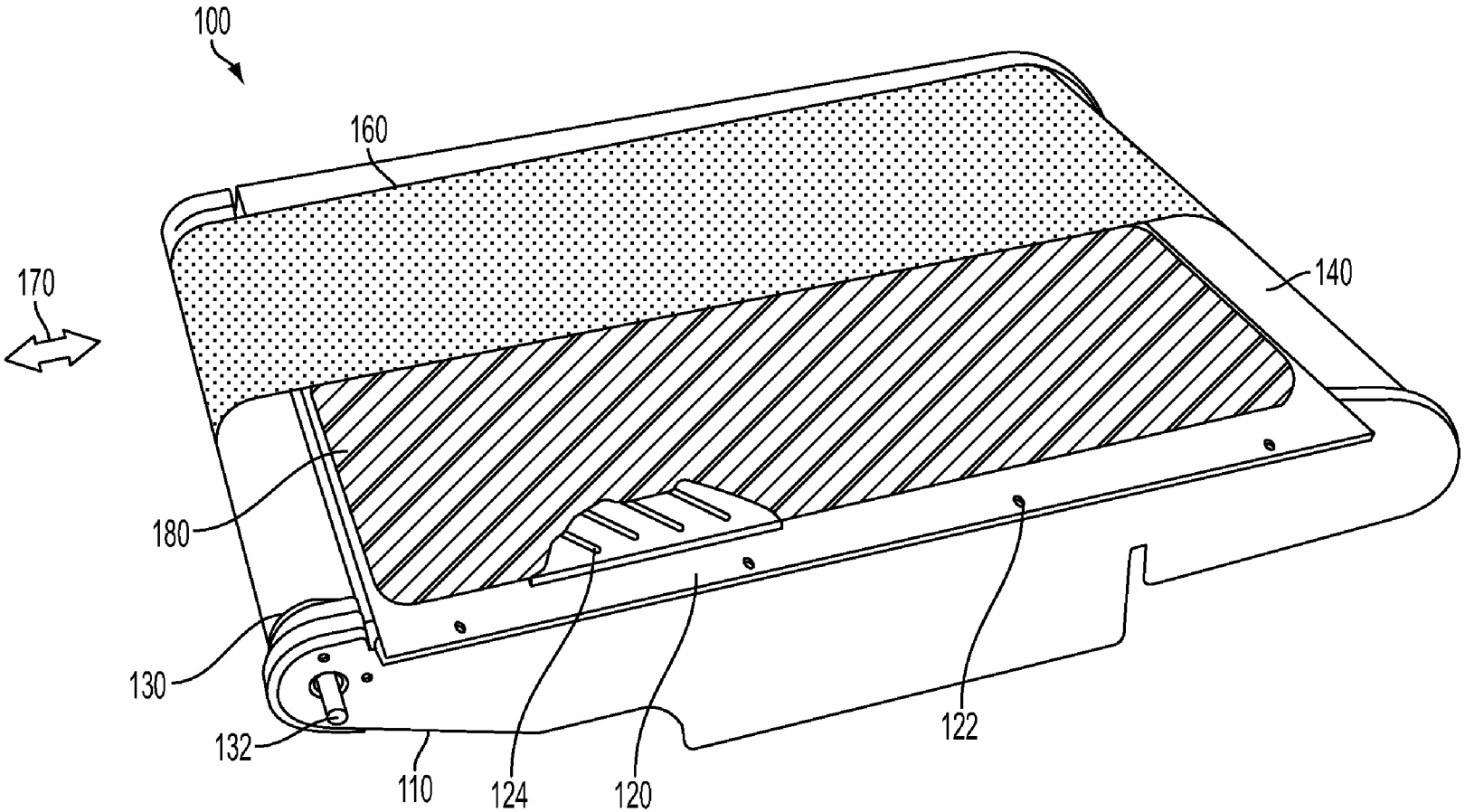
FIG. 2 is a perspective view of the web handling module depicted in FIG. 1 without the web.

A web handling module 100 is illustrated in FIG. 1. The main components shown in FIG. 1 are a housing 110, two rollers 130 and 140, a support plate 120, a series of apertures 124 on the support plate 120, a web 150 positioned over a porous belt 160 which is over the support plate 120 and partially spans the width of the support plate 120, and a sealing cover 180 positioned over the portion of the width of the support plate 120 not covered by the porous belt 160. Referring to FIG. 2, the web handling system 100 is depicted without the web to demonstrate the relationship between the porous belt 160, the sealing cover 180 and the support plate 120. The housing 110 provides a structure for mounting features that are described below. Rollers 130 and 140 are mounted about roller shafts 132 at the two ends of the housing 110. Momentum of the web rotates the rollers 130 and 140 about the roller shafts 132. The support plate 120 is mounted on the top of the housing 110. Fastening and locating holes 122 are provided for aligning and securely mounting the support plate 120 to the housing 110. A series of apertures 124 are provided on the support plate 120. These apertures 124 are provided in different angular relationship with respect to the support plate 120. The apertures 124 are distributed over an area that covers most of the support plate 120. The support plate 120 is configured to have a low friction surface. The low friction surface can be achieved by coating the support plate 120 with an appropriate coating material. A typical coating material used in such applications is Teflon. Alternatively, the low friction surface of the support plate can be achieved by choosing a support plate material that ensures a smooth surface. The apertures 124 and the support plate 120 are described in more detail below.

The porous belt 160 is provided on the top surface of the support plate 120. The porous belt 160 is wound around the rollers 130 and 140 in a tight manner to provide a continuous loop around the rollers 130 and 140. Therefore, moving the porous belt 160 over the support plate 120 causes the rollers 130 and 140 to rotate. As discussed below, a vacuum is applied in the housing to the underside of the support plate 120. The vacuum is pulled through the apertures 124 to couple the porous belt 160 to the web 150. Therefore, while the vacuum is applied, moving the web over the web handling module 100 rotates the porous belt 160 about the support plate 120. While rollers 130 and 140 are shown in FIG. 1, in one embodiment rollers can be substituted with stationary ends having rounded surfaces, in which case the porous belt rotates about the stationary ends. In embodiments in which the porous belt 160 is mounted about rollers 130 and 140, these rollers and any other rollers mounted in contact with the porous belt 160 are driven by the movement of the web 150 coupled to the porous belt 160 by the vacuum. Therefore, the web handling module 100 shown in FIG. 1 advantageously eliminates the need for actuators, e.g., electric motors, to rotate rollers in order to move the web. This advantage, as discussed below, can be used to build up a series of web handling modules 100 in a modularized printing environment.

The porous belt 160 is made of a resilient material and the porous belt 160 has a high level of porosity. The porosity may be a characteristic of the material used for the belt 160 or a series of holes, slits, and the like may be formed in a non-porous material to provide the porosity. The material of the porous belt 160 should be chosen so that the porous belt 160 can slide over the support plate 120 with minimal friction force. That is, the coefficients of friction associated with the porous belt material and the coating of the support plate, or the material of the support plate if no coating is present, should enable a smooth sliding action between the porous belt 160 and the support plate 120.

The material of the porous belt should also be sufficiently pliable such that the porous belt 160 conforms easily to the shape of the support plate 120, even when the porous belt 160 is sliding over the support plate 120. The porous belt 160 needs to conform to the shape of the support plate 120 even when the porous belt is moving over the support plate 120. Furthermore, the material and the thickness of the porous belt should preclude the porous belt from being pulled through the apertures 124 of the support plate 120 because entry of the porous belt 160 into the apertures 124 would prevent or impede the sliding action of the porous belt 160 over the support plate 120. Moreover, the material of the porous belt 160 should be chosen to avoid giving off dust particles as the porous belt 160 slides over the support plate 120 and the rollers 130 and 140. In one embodiment a loop of sheet-metal with small holes may be used as the porous belt 160.

In one embodiment, the width of the porous belt 160 is smaller than the width of the support plate 120. This relationship is shown in FIGS. 1 and 2, where the support plate 120 spans the entire width of the web handling module 100, while the porous belt 160 spans only a portion of the width. Referring to FIG. 1, the support plate 120 and the apertures 124 can be seen on the far left hand side in the cutout of the web 150 and in the cutout of the porous belt 160. The support plate and the apertures can also be seen on the right hand side in the cutout of the sealing cover 180. The sealing cover 180 covers the portion of the support plate 120 that is not covered by the porous belt 160. The area of the support plate 120 that is covered by the sealing cover 180 is hereinafter referred to as the unused portion of the support plate. The unused portion of the support plate exists because in certain applications the width of the web 150, and hence the porous belt 160, is smaller than the width of the support plate 120, as the support plate 120 is provided to handle the largest web width in a class of web applications.

The sealing cover 180 is made of a sufficiently resilient non-porous material to prevent the sealing cover 180 from being pulled through the apertures 124 of the support plate 120 when a vacuum is applied to the underside of the support plate 120. The pliable material needs to flex in order to seal the apertures 124 of the support plate 120 but yet have sufficient thickness so that the sealing cover 180 cannot be pulled through the apertures. An exemplary material for the sealing cover 180 can be rubber. In one embodiment the porous belt 160 covers the entire width of the support plate 120, or at least the portion of the support plate 120 where apertures 124 are present. In this embodiment the sealing cover 180 can be omitted.

The web 150 is transported over the web handling module 100 along the direction of arrows 170. The web is positioned over the porous belt 160. The cutouts shown in FIG. 1 reveal the porous belt 160 under the web 150 and the support plate 120 under the porous belt 160. The width of the web 150 is substantially the same as the width of the porous belt 160. Therefore, the web 150 is configured to be substantially over the porous belt 160 and not over the unused portion of the support plate 120.

Figure 9:
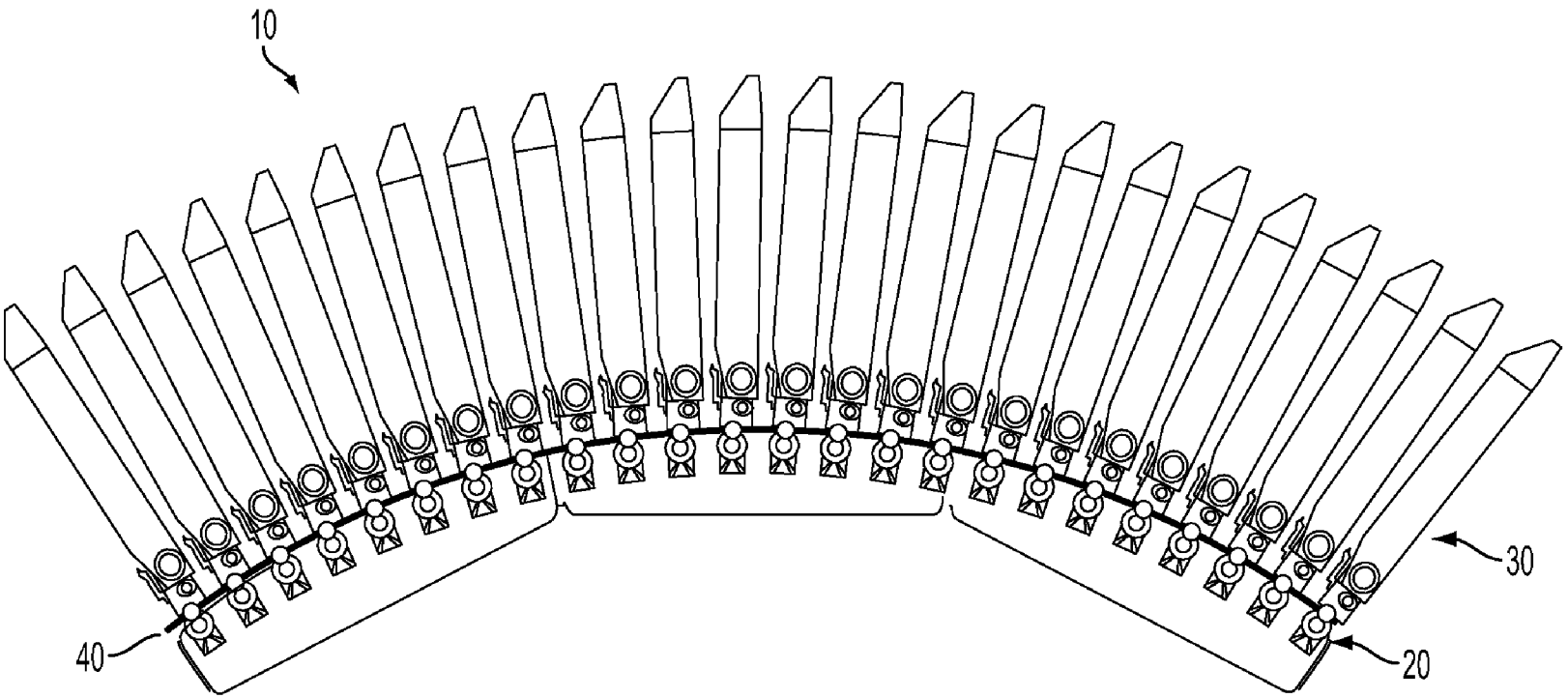
FIG. 9 PRIOR ART
FIG. 9 is a schematic diagram of a web transport system according to the prior art.

In operation, a vacuum is coupled to a plenum (not shown in FIG. 1) in the housing 110 and to the underside of the support plate 120. The vacuum pulls air through the apertures 124 of the support plate 120 and through the porous belt 160. The sealing cover 180 ensures vacuum does not escape through uncovered apertures 124 of the support plate 120 in cases where the web 150 and the porous belt 160 do not cover the entire span of the support plate 120. The vacuum that is pulled through the porous belt 120 pulls the web 150 against the porous belt 160 and toward the support plate 120. The vacuum force exerted on the web applies sufficient normal force to the porous belt and the web to enable the porous belt 160 to move along with the web 150 when the web 150 is moved in the direction of arrows 170. The vacuum also enables the web 150, along with the porous belt 160, to conform to the shape of the support plate 120 to provide a rigid and flat surface for the web 150. Thus the vacuum prevents any fluttering of the web 150. Therefore, the web handling module 100 enables superior printing quality to be achieved as compared to the web handling system of the prior art shown in FIG. 9.

While the web 150 is configured to be substantially over the porous belt 160 and not over the unused portion of the support plate 120, there may be cases where a printing-width of the web, i.e., the portion of the width of the web where the print heads deposit ink, is smaller than the width of the web. In these cases portions of the web which are outside of the printing-width, can be positioned over the sealing cover 180, as any minor fluttering action that may occur in these areas would not affect the print quality.

The configuration of the web handling module 100 shown in FIG. 1 advantageously does not require sliding contact between the web and any surfaces, thereby substantially eliminating production of web dust. The sliding action of the porous belt 160 over the support plate 120 is different than the sliding of the web over the rollers of the web handling system of the prior art shown in FIG. 9 in several ways. First, the porous belt 160 and the support plate 120 are configured to provide low levels of friction. Second, the material of the porous belt 160 is chosen to avoid giving off dust particles. Therefore, the sliding action of the porous belt 150 over the support plate 120 does not generate debris as the previously known webs do as they slide over the rollers.

Figure 3:
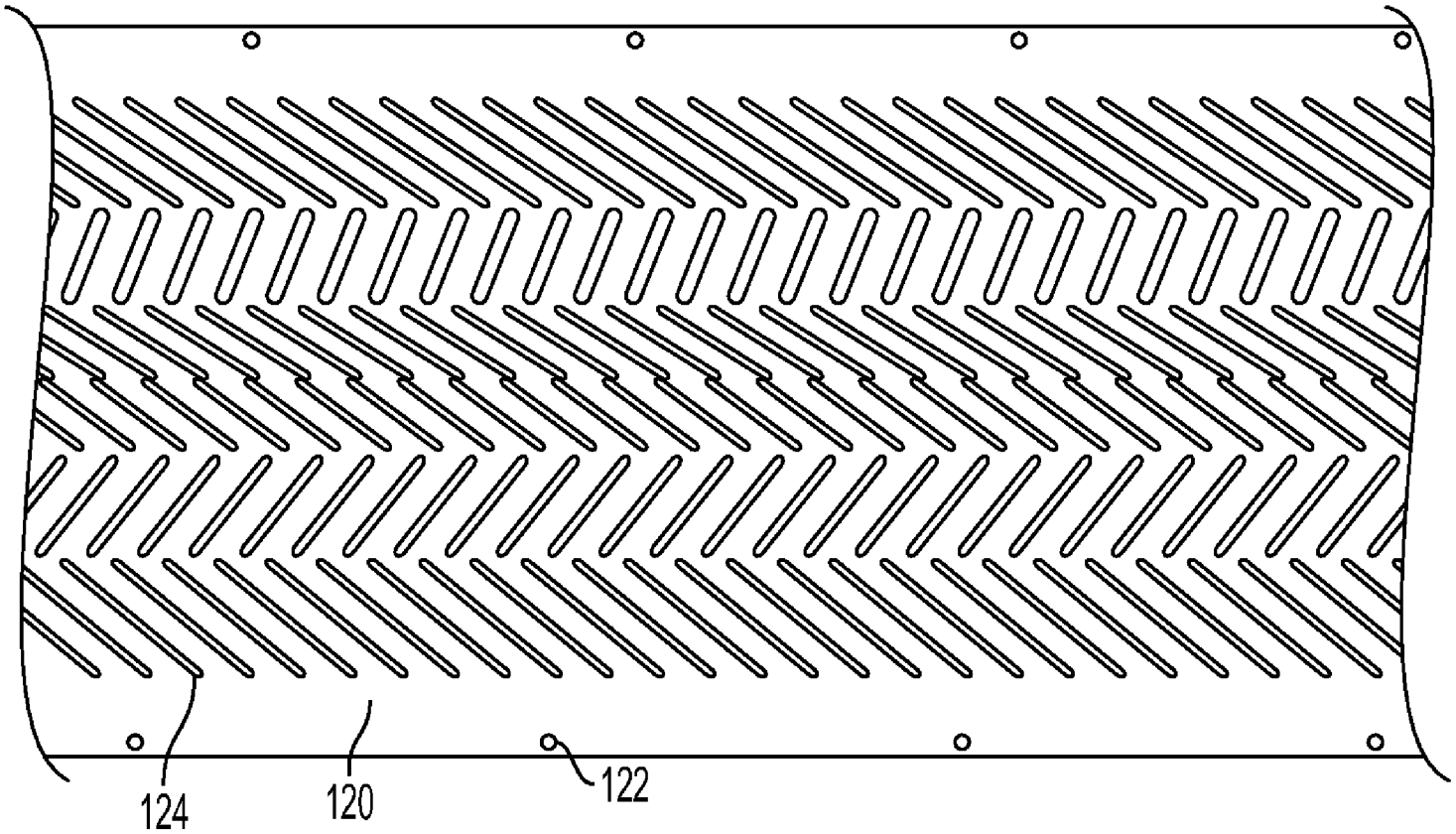
FIG. 3 is a perspective view of a support plate used in the web handling module.

Referring to FIG. 3, the support plate 120 is depicted. The support plate 120 has a plurality of apertures 124 that are provided through the support plate. These apertures 124 are formed in the shape of slits that are placed at varying angular positions with respect to the support plate 120. The apertures 124 are provided with different sizes, e.g., different widths and lengths. Although apertures 124 are shown as slits, other shapes, e.g., circular patterns may be used. The design criteria for these apertures 124 are twofold. First, the apertures 124 should be sized and frequently positioned to provide sufficient vacuum to the porous belt 160 to achieve the required coupling with the web 150. Secondly, formation of these apertures 124 should not remove excessive material from the support plate 120 as to weaken the support plate 120, thereby necessitating a thicker support plate 120. Moreover, the apertures 124 should have rounded edges to prevent damaging the porous belt 160 or impeding the movement of the porous belt 160 as the porous belt 160 is sliding over the support plate 120.

As previously discussed the support plate 120 is configured to have low frictional qualities. In particular, the support plate 120 can be made of a material with few surface irregularities or be coated by an appropriate coating material. The objective is to provide a low frictional surface between the porous belt and the support plate 120 for unencumbered sliding of the porous belt 160 over the support plate.

Figure 4:
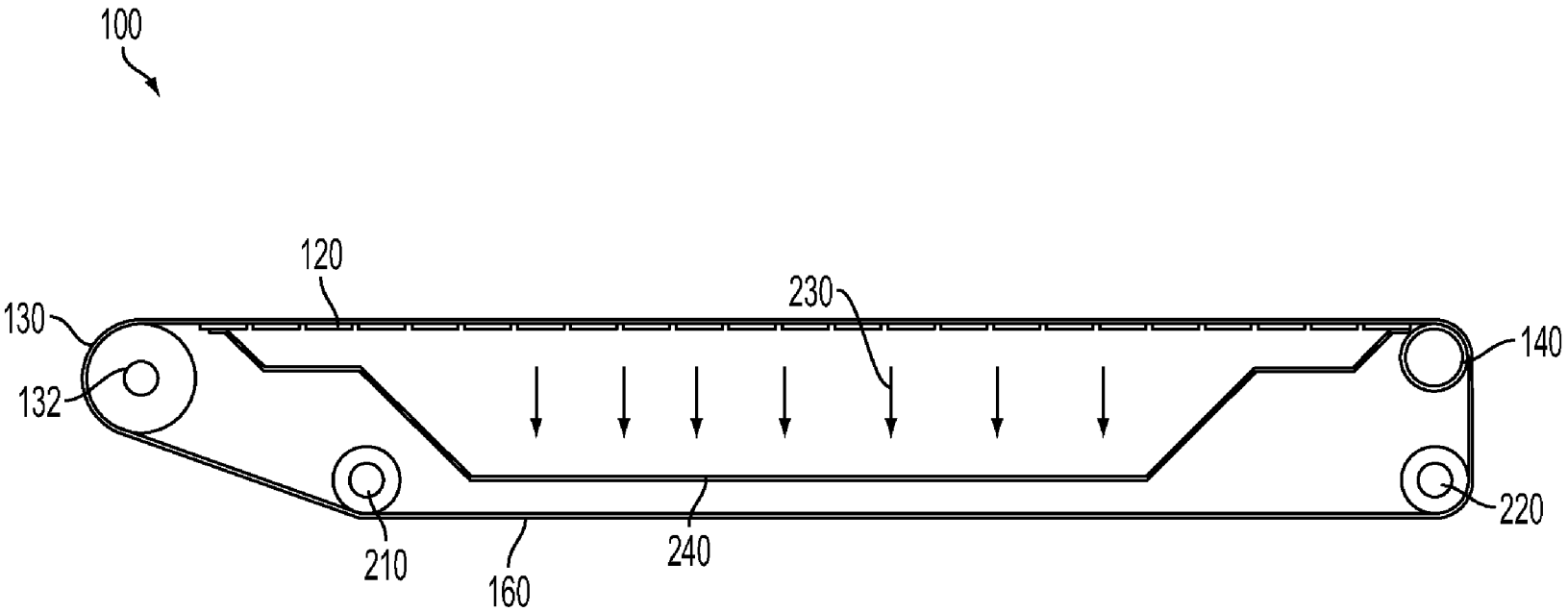
FIG. 4 is schematic diagram of the web handling module.

Referring to FIG. 4, a schematic of the web handling module 100 is provided. The rollers 130 and 140 are found at the opposite ends of the web handling module 100. In one embodiment, the rollers can be replaced with stationary arcuate structures that allow the porous belt 160 to slide over the structures. However, to reduce wear on the porous belt 160 rollers 130 and 140 may be used to rotate along with the porous belt 160. Guiding rollers 210 and 220 define the shape the porous belt 160 assumes as it continuously travels around the web handling module 100. Although two guiding rollers 210 and 220 are shown, a single guiding roller or three or more guiding rollers may be used to accomplish the same function. The porous belt 160 travelling around rollers 130 and 140 and around guiding rollers 210 and 220 can provide a pattern that is similar to the shape of the plenum 240. For example, the plenum 240 and the porous belt 160 both are shaped according to a trapezoid. However, both the plenum and the shape that the porous belt 160 assumes could be a conical shape, in which only one guiding roller would be used on the porous belt 160.

Inside the plenum 240, a vacuum shown by arrows 230 is generated. The vacuum can be generated by an air pump positioned inside the plenum 240 pulling in air through the support plate 120 and pumping the air to the outside of the plenum 240 through air vents (not shown in FIG. 4). Alternatively, the vacuum can be generated outside of the plenum and applied to the plenum 240 by way of ducts which then provide the vacuum to the supporting plate 120. In either case, the plenum 240 is coupled to the support plate 120 to provide an airtight interface.

Figure 5:
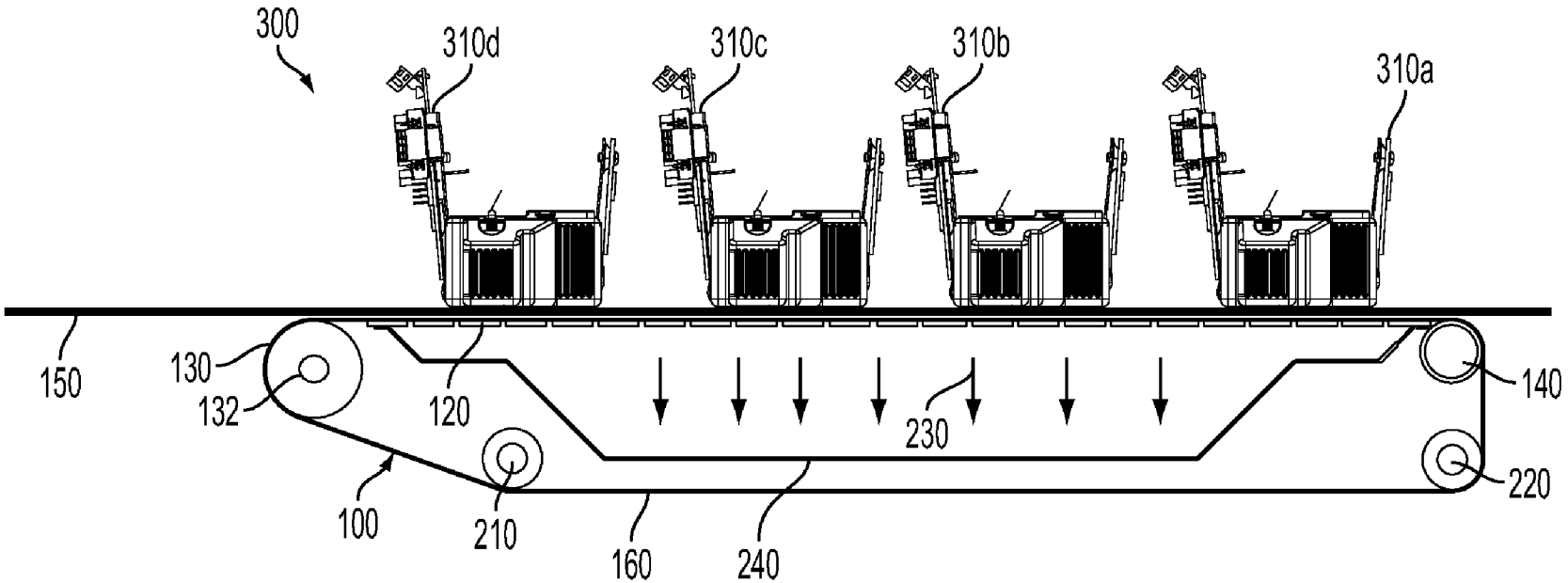
FIG. 5 is a schematic diagram of the web handling module with the web positioned above the web handling module and print heads positioned above the web.

Referring to FIG. 5, a printing module 300 is depicted. The printing module 300 has a web handling module 100 and a plurality of print heads 310*a*-310*d*, or as discussed below a plurality of print head arrays 312*a*-312*d*. As the vacuum 230 is applied to the support plate 120, the vacuum pulls the web 150 and the porous belt 160 against the support plate 120. The support plate provides a flat and consistent surface for the web. While the web 150 is moved, the porous belt 160 moves with the web 150 around the rollers 130 and 140 and guide rollers 210 and 220. A series of print heads 310*a*-310*d* are provided over the web 150 at a distance away from the web that allows for proper application of ink from the print heads onto the web. Four print heads 310*a*-310*d* are shown in FIG. 5.

Figure 6:
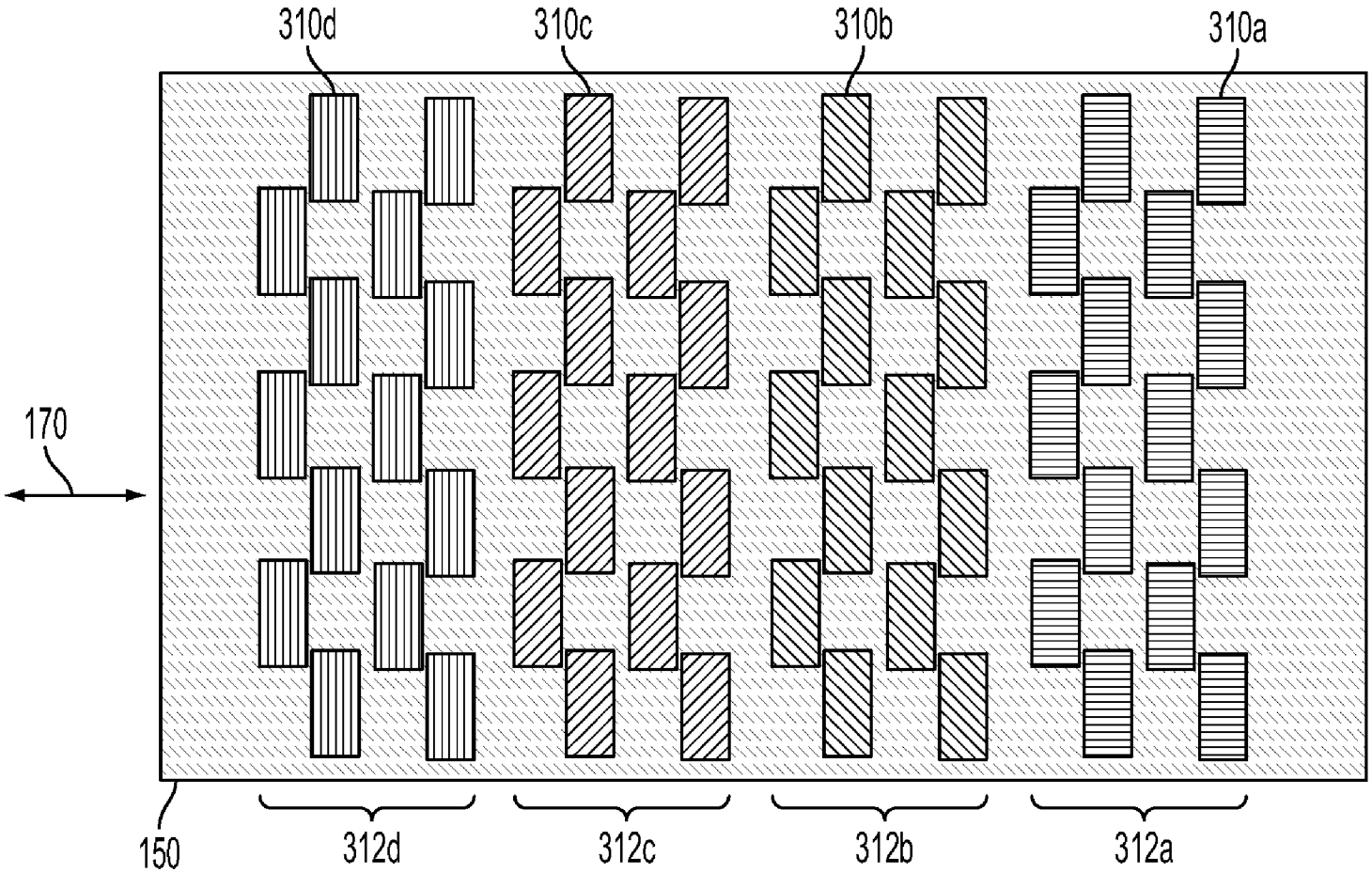
FIG. 6 is a schematic diagram of print heads positioned over a web.

Each of the print heads 310*a*-310*d* can be a member of an array having multiple print heads which are positioned in series along the width of the web. An exemplary embodiment of arrays of print heads 312*a*-312*d* is shown in FIG. 6. A series of print heads 310*a* form an array 312*a*. The print heads of each array are positioned in a staggered fashion above the web 150. The pattern of arrays of print heads 312*a*-312*d* shown in FIG. 6 provides a configuration such that a length of the web that spans the distance between arrays 312*a*-312*d* can be printed at once. This simultaneous printing capability improves efficiency of printing of the web in high speed printing applications. In one embodiment, each array 312*a*-312*d* of print heads can be configured to print a different color. In this embodiment, a full color image can be printed on the web each time the web passes through a single printing module 300. Alternatively, in another embodiment, all arrays 312*a*-312*d* of each printing module are configured to print the same color. In this embodiment, a full color image is printed on the web after the web has passed through multiple printing modules 300, as part of a printing environment.

Figure 7:
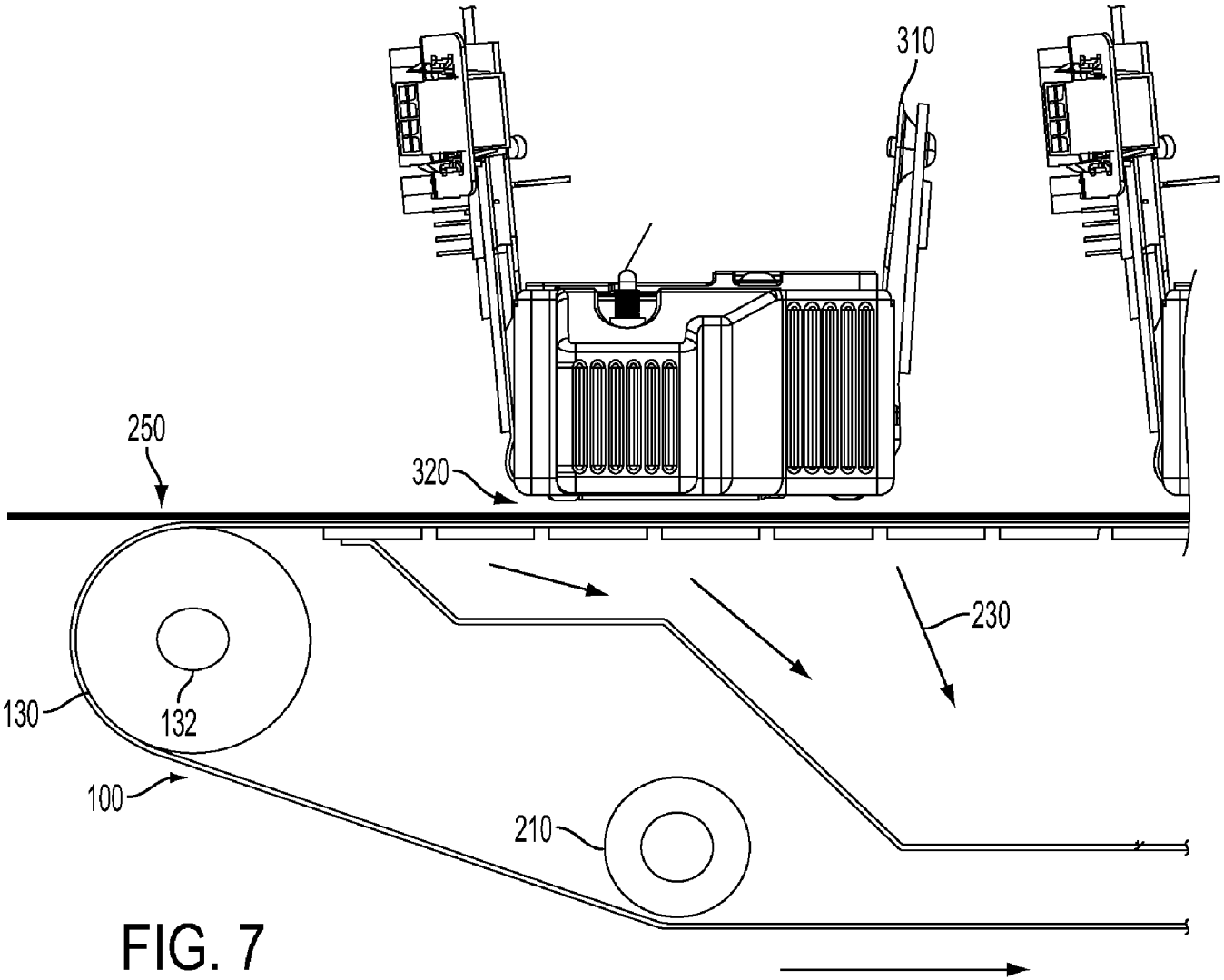
FIG. 7 is a schematic diagram of the web handling module at one end of the module providing a detailed view of a print head in relationship to the web.

Referring to FIG. 7, a close up of the schematic of FIG. 5 at the end close to the roller 130 is provided. The vacuum pulls the web 150 and the porous belt 160 on to the support plate

120, thereby providing a flat and consistent web surface onto which the print head 310 is able to eject ink. The web, therefore, is positioned at a consistent distance 320 away from the print head 310, as required to achieve high quality printing. Therefore, the print heads 310 can all be positioned vertically at the same distance 310 away from the web 150. This arrangement advantageously eliminates the requirement of arcuate placement of the print heads shown in FIG. 1. A consistent vertical placement of the print heads 310 is advantageous since such a placement configuration allows for a modular implementation of the web handling module 100 as compared to the implementation of the prior art, depicted in FIG. 9, where the arcuate path prevented a long modular implementation. In FIG. 7 reference numeral 250 represents the point where the porous belt and the web are no longer in contact.

Figure 8:
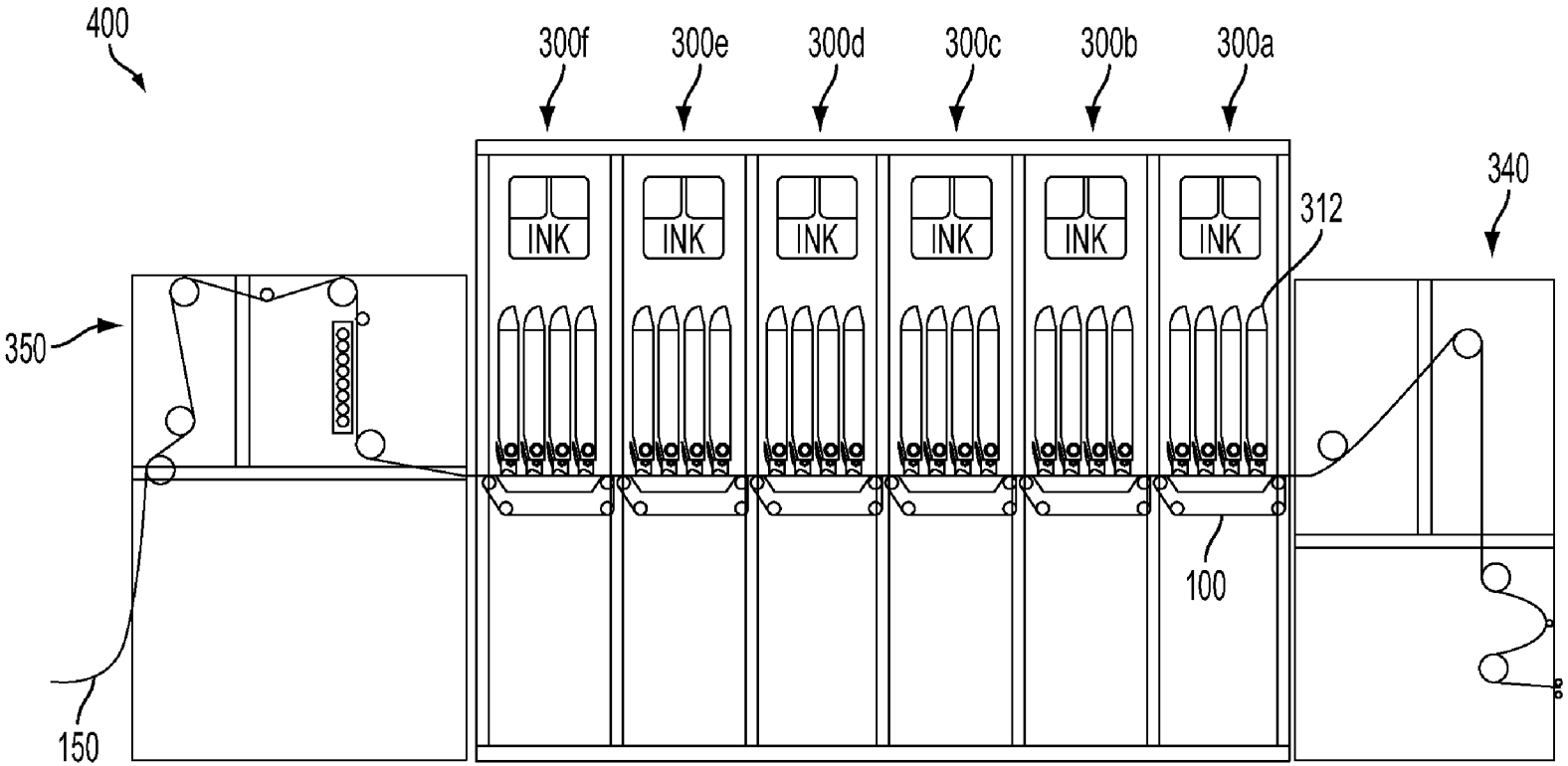
FIG. 8 is a schematic diagram of a series of web handling modules positioned side by side each module having the web over the module and print heads over the web as well as a web feeder and a web stacker.

Referring to FIG. 8, a printing production environment 400 is shown. There are six printing modules 300*a*-300*f*, each printing module 300 has a plurality of arrays 312, as described above with reference to FIG. 6, and a single web handling module 100. The printing module 300*a*, on the right, receives the web 150 from a web feeder 340. Upon being printed, the web 150 exits the last printing module 300*f*, on the left hand side of FIG. 8, and enters the web stacker 350. The web stacker 350 drives the web 150 over a series of rollers and processes the web 150 to other processing units downstream (not shown).

As previously discussed, the printing production environment 400 takes advantage of the moving web to rotate the rollers 130 and 140 of the web handling module 100. Because the web 150 rotates the porous belt 160 and the rollers 130 and 140, actuators are not required to drive the rollers 130 and 140. Thus, the web movement does not need to be synchronized with the rotation of rollers driven by actuators. Elimination of this synchronization requirement by avoiding actuator rollers improves motion quality of the web 150, which is important in a web printing application.

The capability to provide additional printing modules 300 in a modular fashion is clearly demonstrated in FIG. 8. Each web handling module 100 is placed next to another web handling module 100 so that the porous belt 160 of each module is at the proximity of another module. The proximity of each module to the next is not a critical design consideration. Close proximity allows for a smaller floor space. However, the modules should not be placed so close that the porous belts 160 make contact with one another, as this condition may prevent proper operation and/or shorten the life of the porous belts 160.

It will be appreciated that various of the above-disclosed and other features, and functions, or alternatives thereof, may be desirably combined into many other different systems or applications. A few of the alternative implementations may comprise various combinations of the methods and techniques described. Various presently unforeseen or unanticipated alternatives, modifications, variations, or improvements therein may be subsequently made by those skilled in the art, which are also intended to be encompassed by the following claims.

The invention claimed is:

1. A web handling module for horizontally transporting a web under a printer having at least one print head, comprising:

a housing having an opening;

a support plate sealingly coupled to the housing to cover the opening and form a plenum, the support plate having a plurality of apertures configured to allow air to pass through the plurality of apertures;

an air vent coupled to the housing to communicate with the plenum, the air vent being coupled to an air handler that is configured to generate a negative air pressure inside the plenum;

a porous belt wound about the support plate and the housing to form a continuous loop about the support plate and the housing, the porous belt covering only a portion of an area of the support plate and an area of the support plate not covered by the porous belt includes a plurality of apertures, the porous belt enabling the negative air pressure within the plenum to couple a moving web to the porous belt and move the porous belt over the support plate to rotate the porous belt about the support plate and the housing without relative motion occurring between the web and the porous belt; and a sealing cover dimensioned to cover only the uncovered area of the support plate, the sealing cover being configured to prevent air from entering the plenum through the plurality of apertures present in the uncovered area of the support plate, the sealing cover being made of a resilient, non-porous material.

2. The web handling module of claim 1 further comprising:

a first roller and a second roller disposed outside of the plenum, the first and the second rollers being configured to wind the porous belt into a loop.

3. The web handling module of claim 2 further comprising:

at least one guiding roller disposed outside of the plenum and configured to cooperate with the first and the second rollers to wind the porous belt into the loop.

4. The web handling module of claim 1 wherein widths of the porous belt and the web are substantially equal and the porous belt and the web are aligned.

5. The web handling module of claim 1, wherein the air handler is inside the plenum.

6. The web handling module of claim 1, wherein the air handler is outside the plenum.

7. The web handling module of claim 1, further comprising:

at least one printing head disposed over the web and configured to eject ink onto the web as the web is moving over the support plate.

8. The web handling module of claim 1, wherein the support plate and the porous belt are configured to have a low frictional interface.

9. The web handling module of claim 8, wherein the support plate is coated with a low friction coating.

10. The web handling module of claim 1 wherein the porous belt is made of a material that is integrally porous.

11. The web handling module of claim 1 wherein the porous belt is made of a material that is non-porous that has a plurality of apertures formed in the material.

12. A printing production environment comprising:

a plurality of web handling modules, each web handling module of the plurality having a housing with an opening, a support plate sealingly coupled to the housing to form a plenum, the support plate having a plurality of apertures configured to allow air to pass through the plurality of apertures into the plenum, an air vent coupled to the housing, the air vent being coupled to an air handler and configured to generate a negative air pressure inside the plenum, a porous belt wound about the support plate and housing to form a continuous loop, the porous belt covering only a portion of an area of the support plate and an area of the support plate not covered by the porous belt includes a plurality of apertures, the porous belt enabling the negative air pressure to couple a moving web to the porous belt to enable the porous belt to move over the support plate to rotate the porous belt about the support plate without relative motion occurring between the web and the porous belt;

a sealing cover dimensioned to cover only the uncovered area of the support plate, the sealing cover being configured to prevent air from entering the plenum through the plurality of apertures present in the uncovered area of the support plate, the sealing cover being made of a resilient, non-porous material a web feeder configured to receive the web from a web source and to provide the web to the plurality of the web handling modules;

a web stacker configured to receive the web from the plurality of the web handling modules and to provide the web to a downstream web handling unit; and a plurality of print heads, a number of printheads in the plurality of printheads being positioned opposite one of the web handling modules in the plurality of web handling modules disposed above the web, the printheads in the plurality of printheads being configured to eject ink onto the web as the web is moving over the support plate.

13. The printing production environment of claim 12 wherein the number of print heads opposite one of the web handling modules are staggered according to a predetermined pattern to enable the number of printheads to print a line across a width of the web.

* * * * *